US005597975A

United States Patent [19]

Satow

[11] Patent Number: 5,597,975

[45] Date of Patent: Jan. 28, 1997

[54] MECHANICAL PLATING OF SMALL ARMS PROJECTILES

[75] Inventor: Arnold Satow, New City, N.Y.

[73] Assignee: McGean-Rohco, Inc., Cleveland, Ohio

[21] Appl. No.: 539,234

[22] Filed: Oct. 4, 1995

[51] Int. Cl.[6] ..... B05D 3/12; F42B 5/02

[52] U.S. Cl. ..... 102/514; 102/459; 205/85; 427/11; 427/242

[58] Field of Search ..... 427/242, 11; 205/85; 29/123; 102/459, 514, 516

[56] References Cited

U.S. PATENT DOCUMENTS

| | | | |
|---|---|---|---|
| 1,992,244 | 2/1935 | Schuricht | 204/10 |
| 3,349,711 | 10/1967 | Darigo et al. | 102/91 |
| 3,431,612 | 3/1969 | Darigo et al. | 29/1.23 |
| 3,755,107 | 8/1973 | Keith et al. | 204/98 |
| 4,379,834 | 4/1983 | Herwig et al. | 430/329 |
| 4,389,431 | 6/1983 | Erismann | 427/242 |
| 4,454,175 | 6/1984 | Martin | 427/242 |
| 4,734,179 | 3/1988 | Trammel | 204/199 |
| 5,378,499 | 1/1995 | Martin et al. | 427/242 |

*Primary Examiner*—Kathryn Gorgos
*Assistant Examiner*—William T. Leader
*Attorney, Agent, or Firm*—William J. Willis

[57] ABSTRACT

The present invention relates to a process for mechanically plating small arms projectiles with a particulate plating metal to form jacketed small arms projectiles. The process comprises agitating a slurry comprising the small arms projectiles, an aqueous solution of a strong acid, a plating agent and the particulate plating metal, thereby producing a jacketed small arms projectile having improved lubricity characteristics and in less time than prior art methods employing electrodeposition to form the jacketed small arms projectiles.

15 Claims, No Drawings

MECHANICAL PLATING OF SMALL ARMS PROJECTILES

TECHNICAL FIELD

This invention relates to a process for mechanically plating small arms projectiles with a particulate plating metal to form jacketed small arms projectiles and the small arms projectiles so plated.

BACKGROUND OF THE INVENTION

The need for and use of jacketed small arms ammunition projectiles is well known. T. F. Werme in U.S. Pat. No. 2,336,143 discusses the conventional method of making jacketed projectiles in the 1941–1943 period which utilized a multiplicity of operations comprising first alternate drawings and annealings of a gilding metal jacket disc until it is formed in the shape of an elongated cup and then subsequently inserting a separately formed slug into the prepared jacket. In addition to the multi-operations and expensive equipment needed to make jacketed projectiles under this process, the end product had certain undesirable deficiencies such as variation in the jacket thickness and concentricity. This was the conventional method of making jacketed projectiles until the late 1960's when J. Darigo, et al. disclosed in U.S. Pat. Nos. 3,349,711 and 3,431,612 a method of making a small arms jacketed projectile by electrodepositing a deformable metal jacket over a softer deformable projectile core and then forming the plated projectile to its final dimensions.

As disclosed in the Darigo patents, lead cores are tumbled and deburred, cleaned, rinsed, pickled, rinsed and then given a copper strike in a plating bath for a predetermined period of time until the lead cores are entirely covered with a thin coating of copper. This copper strike plating bath, which is generally an alkaline cyanide containing formulation, is neccessary to prevent the main plating bath from becoming contaminated with lead. The main plating bath, which is strongly acidic, would dissolve lead and produce copper jackets that tended to be brittle.

The thinly copper coated cores are then electroplated in the main bath until the necessary thickness of copper has been deposited thereon. The resulting jacketed projectiles are then rinsed, pickled, rinsed, a corrosion inhibitor added and then dried. The plated projectiles are then fed to final forming dies where they are formed to the desired configuration and dimensions required.

More than 25 years since its' introduction, the above-described electroplating method is still widely used in the production of jacketed small arms projectiles, even though manufacturers have had to cope with numerous processing steps, the danger of cyanide in the strike bath and the added cost for its' waste treatment and disposal. In addition, long plating times are required in the main electroplating bath to deposit the thickness required for the jacketed small arms projectiles. The present invention is directed to providing a new process to produce jacketed small arms projectiles which decreases the number of process steps, eliminates the use of cyanide and its associated disadvantages, and significantly reduces the overall processing time while providing jacketed small arms projectiles that exhibit improved lubricity characteristics. This characteristic can greatly improve the ability of the part to be further formed or deformed which is an important step in the manufacture and subsequent final use of the jacketed small arms projectiles as firearms ammunition.

SUMMARY OF THE INVENTION

The present invention relates to a new process of making improved jacketed small arms ammunition projectiles. More specifically, the invention refers to mechanically plating a jacket onto a deformable projectile core, thereby providing a process which is more rapid, economical and more environment friendly than the conventional method utilizing electroplating to form the jacketed projectiles.

In addition, the jacketed projectiles manufactured according to the present invention exhibit improved lubricity characteristics which can greatly improve the ability of the jacketed projectile cores to be further formed or deformed which is an important step in the manufacture and subsequent use of the small arms projectiles.

Other benefits and advantages of the invention will become apparent from the following description.

DESCRIPTION OF THE PREFERRED EMBODIMENTS

The process for making jacketed small arms projectiles of the present invention comprises mechanically plating small arms projectiles with a coating of a metal to produce the jacketed small arms projectiles.

In the process of the invention the small arms projectiles are contacted with an aqueous solution which contains components comprising a strong acid, which removes oxides or scales from the surface of the small arms projectiles.

The projectiles are then rinsed with water and placed in an agitatable container along with an aqueous slurry comprising a plating agent and a particulate plating metal. The container is then agitated until the desired thickness of the particulate plating metal has been mechanically plated over the surface of the projectiles.

The small arms projectiles to be mechanically plated have a composition consisting of a deformable metal selected from the group consisting of lead, an alloy of lead and an alloy of bismuth. The preferred alloy of lead is a lead-antimony alloy containing 0.5 to 8% by weight antimony. The lead-antimony alloys may also contain arsenic in an amount equal to about 20 to 30% by weight of the antimony content.

The bismuth alloy contains about 50 to 99% by weight bismuth and another metal selected from the group consisting of tin, antimony, zinc and mixtures thereof.

The small arms projectiles to be jacketed by the process of the invention can be of any size normally employed as small arms ammunition. For example, shotgun pellets of BBB to "dust" shot size, and OOO to T size, 0.22 caliber bullets, 0.45 caliber bullets, 9 mm caliber bullets and wire pieces that are cut prior to final forming into bullet shapes.

In general, the thickness of the jacket applied to the small arms projectiles by the process of the invention can vary widely depending on the needs of the ammunition manufacturers. Some may want a very thin coating of 5 micrometers or less to act as mostly a color match to general industry standards. Others may require a thick coating of as much as 100 micrometers or more to provide sufficient resistance to "leading" in the gun bore or barrel upon firing. "Leading" is the tendency to leave lead and other deposits in the firing device that can build up and interfere with firing accuracy, firing device reliability and ballistics.

The preferred strong acid contained in the aqueous solution, with which the small arms projectiles to be mechanically plated are contacted in order to remove oxides and scales from the projectile surface is selected from the group consisting of fluoboric acid, alkane sulfonic acid and alkanol sulfonic acid.

The alkane and alkanol sulfonic acids that can be utilized in the present invention are characterized by the formulae $$RSO_3H \quad (I)$$

$$C_nH_{2n+1}—CH(OH)—(CH_2)_m—SO_3H \quad (II)$$

respectively, where R is an aliphatic group containing from 1 to about 12 carbon atoms, n is from 0 to about 10, m is from 1 to about 11, and the sum of m+n is up to about 12.

Examples of alkane sulfonic acids as described by formula (I) include, for example, methane sulfonic acid, ethane sulfonic acid, propane sulfonic acid, 2-propane sulfonic acid, butane sulfonic acid, 2-butane sulfonic acid, pentane sulfonic acid and dodecane sulfonic acid.

Examples of alkanol sulfonic acids as described by formula (II) include, for example, 2-hydroxy ethyl-1-sulfonic acid, 1-hydroxy propyl-2-sulfonic acid, 2-hydroxy propyl-1-sulfonic acid, 3-hydroxy propyl-1-sulfonic acid, 4-hydroxy butyl-1-sulfonic acid, 2-hydroxy pentyl-1-sulfonic acid, 2-hydroxy hexyl-1-sulfonic acid, 2-hydroxy decyl-1-sulfonic acid and 2-hydroxy dodecyl-1-sulfonic acid.

The strong acid named above are avialable commercially and the alkane and alkanol sulfonic acids can also be prepared by a variety of methods known in the art. One method comprises the catalytic oxidation of mercaptans or aliphatic sulfides having the formula $R_1S_nR_2$ wherein $R_1$ or $R_2$ are alkyl groups and n is a positive integer between 1 nd 6. Air or oxygen may be used as the oxidizing agent, and various nitrogen oxides can be employed as catalysts. The oxidation generally is effected at temperatures below about 150° C. Such oxidation processes are described and claimed in U.S. Pat. Nos. 2,433,395 and 2,433,396. Alternatively, chlorine can be used as the oxidizing agent.

The preferred strong acids to be used in the present invention are fluoboric acid and methane sulfonic acid. The most preferred strong acid is fluoboric acid. The amount of strong acid in the aqueous solution will generally be from about 1 to about 50% by weight. The preferred amount of strong acid in the aqueous solution is from about 2 to about 10% by weight.

The plating agent in the aqueous slurry with the particulate plating metal function as effective means for dispersing the particulate plating metal in the aqueous slurry. Among the materials useful as dispersants in the aqueous plating agent are anionic sulfonic acids or salts thereof. These compounds are obtained by the polycondensation of formaldehyde and an aromatic sulfonic acid which generally is a naphthalene sulfonic acid. Polycondensation products of this type are available commercially from BASF under the designation TAMOL NNO; from Stepan Chemical Company under the designation STEPANTAN A; and from GAF under the general trade designations BLANCOL N and BLANCOL DISPERSANT.

Aromatic sulfonic acids or salts thereof may be used as dispersants in the instant invention. Examples of aromatic sulfonic acids, or soluble salts thereof, which may be used are a soluble salt of a xylene sulfonic acid such as those available from Arco Chemical Company under the general trade designation ULTRAWET; and a soluble salt of cumyl sulfonic acid.

Other anionic dispersing agents effective for inclusion in the plating agent are soluble metal salts of the sulfate ester of aliphatic alcohols. Examples include the sodium salt of the sulfate ester of 2-ethyl-1-hexanol available commercially from a number of vendors including, for example, Niaset Corporation under the trade designation NIAPROOF O8; The Henkel Chemicals Company (Canada) under the designation SULFOTAX CA; from BASF under the trade designation LUGALVAN TC-EHS; etc., and the sodium salt of the sulfate ester of n-octyl alcohol, available commercially under the trade designation RHODAPON OLS from Rhone Poulenc, Inc.

The plating agents useful in the invention may also utilize as dispersants a class of compounds generally designated nonionic surfactants. These nonionic surfactants comprise ethylene oxide and/or propylene oxide condensate adducts. Surfactants of this type include, but are not limited to, ethoxylated alkyl phenols, ethoxylated fatty alcohols, ethoxylated fatty acids, ethoxylated fatty acid amides, polyethoxylated amines, polyethylene oxide condensates, and block copolymers of ethylene oxide and propylene oxide based on propylene glycol or ethylene glycol. Generally, the surfactants will contain up to about 40 or more ethylene oxide units.

Examples of ethoxylated alkyl phenols wherein the alkyl groups include octyl, isooctyl, nonyl, dodecyl, and octodecyl are available commercially under a variety of trademarks such as SURFONIC from Jefferson Chemical Co., RENEX from Atlas Chemical Industries, Inc., and IGEPAL from GAF Corporation Chemical Products.

Examples of Polyethylene oxide or polyethylene glycol condensates that are commercially available include those from Union Carbide under the general trade designation CARBOWAX. Specific examples include CARBOWAX No. 1000 which has a molecular weight range from about 950 to 1050 and contains from 20 to 24 ethoxy units per molecule. CARBOWAX No. 4000 has a molecular weight range of from about 3000 to 3700 and contains from 65 to 85 ethoxy units per molecule.

Ethoxylated aliphatic alcohols useful as surfactants in the aqueous plating agent have an aliphatic portion containing from about 8 to about 24 carbon atoms condensed with from about 5 to about 30 moles of ethylene oxide per mole of aliphatic alcohol. A number of ethoxylated aliphatic alcohols are available commercially such as from Emery Industries under the general trademark TRYCOL. A specific example is TRYCOL OAL-23 which is an ethoxylated oleyl alcohol.

Alkoxylated alcohols also are available from Chemax, Inc. under the general trade designation CHEMAL. Examples include CHEMAL TDA which is an ethoxylated tridecyl alcohol, CHEMAL OA which is an ethoxylated oleyl alcohol and CHEMAL LA, an ethoxlylated lauryl alcohol.

The surfactant also may be an ethoxylated fatty acid which can be obtained by reacting ethylene oxide with a fatty acid such as oleic acid, stearic acid, palmitic acid, etc. The ethoxylated fatty acids are available commercially such as from Armak Industries, Chemical Division under the trademark ETHOFAT. Specific examples are: ETHOFAT C/15, which is a coco acid ethoxylated with 5 moles of ethylene oxide, and ETHOFATs O/15 and O/20, which are oleic acid reacted with 5 and 10 moles of ethylene oxide respectively.

Ethoxylated fatty acid amides useful as the surfactant component of the plating agent can be obtained by reaction ethylene oxide with a fatty acid amide such as oleamide, stearamide, coconut fatty acid amides and lauric amide. The ethoxylated fatty acid amides, which may also be identified as ethoxylated alkylolamides are commercially available from, for example, The Stepan Chemical Company under the general trade designation AMIDOX, and from Armak under the trademark ETHOMID.

Ethoxylated amines may also be used as the surfactant and can be obtained by reacting ethylene oxide or propylene oxide with primary fatty amines which may be a single amine or a mixture of Mines such as are obtained by the hydrolysis of tallow oils, sperm oils, coconut oils, etc. A number of such alkoxylated amines are commercially available from a variety of sources, for example, from the Armak Chemical Division of Akzona, Inc. under the general trade designation ETHOMEEN. Specific examples of such products include ETHOMEEN C/15 which is an ethylene oxide condensate of a coconut fatty amine containing about 5 moles of ethylene oxide; and ETHOMEENs T/15 and T/25 which are ethylene oxide condensation products of tallow amine containing about 5 and 15 moles of ethylene oxide per mole of amine respectively.

Another type of nonionic ethoxylated surfactant which is useful in the plating agent are block copolymers of ethylene oxide and propylene oxide based on a glycol such as ethylene glycol or propylene glycol. The copolymers based on ethylene glycol generally are prepared by forming a hydrophilic base by reaction of ethylene oxide with ethylene glycol followed by condensation of this intermediate product with propylene oxide. The copolymers based on propylene glycol similarly are prepared by reacting propylene oxide with propylene glycol to form the intermediate compound which is then condensed with ethylene oxide. Both of the above types of copolymers are available commercially such as from BASF Corporation under the general trademark PLURONIC. The condensates based on ethylene glycol are identified as the "R" series, and these compounds preferablly contain from about 30 to about 80% of polyoxyethylene in the molecule and may be either liquids or solids. The condensates based on propylene glycol are identified generally by BASF as the "F", "L", or "P" series and these may contain from about 5 to about 80% of ethylene oxide by weight. The "L" series of propylene glycol based copolymers are liquids, the "F" series are solids and the "P" series are pastes.

In one embodiment of the invention the plating agent comprises an aqueous solution of one or more of the dispersants or surfactants described herein. The preferred amount of dispersant or surfactant in the aqueous solution is from about 2 to about 50% by weight of the aqueous plating agent, the remainder being water.

In another embodiment of the invention the plating agent additionally contains one or more acids selected from the group consisitng of fluoboric acid, alkane sulfonic acid and alkanol sulfonic acid. The alkane and alkanol sulfonic acids that can be utilizid in the plating agent are characterized by formulae (I) and (II). The preferred amount of acid in the plating agent is from about 1 to about 50% by weight of the plating agent.

The preferred particulate plating metal used to form the jacket on the small arms projectiles is selected from the group consisting of copper, tin and an alloy of copper and tin.

In one embodiment of the invention the preferred particulate plating metal is copper and the amount of particulate copper needed to achieve the desired jacket thickness on the surface of the small arms projectile is added in one portion to the agitated container along with the small arms projectiles and the aqueous plating agent.

In a preferred embodiment of the invention the particulate plating metal is copper and the amount of particulate copper needed to achieve the desired jacket thickness on the surface of the small arms projectile is devided into a number of portions and each portion is added to the agitated container, which has therein the small arms projectiles and the aqueous plating agent, over a period of time such that the previous portion of particulate copper has been mechanically plated onto the surface of the small arms projectiles before a subsequent portion of particulate copper is added.

In another preferred embodiment of the invention portions of particulate tin and particulate copper, starting with the tin, are alternately added to the agitated container, which has therein the small arms projectiles and the aqueous plating agent, over a period of time such that the previous portion of particulate tin or copper has been mechanically plated onto the surface of the small arms projectiles before a subsequent portion of particulate tin or copper is added.

The particulate plating metals are generally in the form of finely divided powders and preferably capable of passing through a 100 mesh screen. The powders may be spherical or nonspherical in shape. The preferred shape of the copper and/or tin powders is nonspherical. The most preferred nonspherical copper powder is referred to as a "popcorn" shaped particle in the trade, as it resembles the kernel of corn after popping. This nonspherical "popcorn" powder is available commercially from, for example, McGean-Rohco, Inc. of Cleveland, Ohio under the general trade designation Tru-Plate Copper Dust Cu-155.

In a preferred embodiment of the invention the tin is introduced as a metallic powder.

In another embodiment of the invention the tin may be added in the form of a salt, including, for example, stannous chloride, stannous sulfate, stannous oxide, etc., which will dissolve in the acidified aqueous slurry containing the small arms projectiles, particulate copper and the plating agent. The tin will then plate out on the copper layer of the projectile by introducing into the slurry another metal higher in the electromotive series than tin, such as, for example, zinc. This method of "displacement plating" is well known in the mechanical plating art and need not be discussed further here.

In general, the addition of an impact media, for example glass beads, is not required for mechanically plating the small arms projectiles, but the use of such media is within the scope of the invention.

The process of the invention can be conducted under acidic or alkaline conditions. The preferred acidic range is pH range of about 1 to about 6 and the preferred alkaline range is a pH of about 8 to about 14. The process of the invention by which a metallic jacket is mechanically plated onto the surface of the small arms projectiles is illustrated by the following examples. Unless otherwise indicated, all parts and percentages are by weight. The temperature is ambient, about 75–85 degrees Farenheit, unless otherwise indicated, and pressures are at or near atmospheric pressure.

In the examples below, the following aqueous acid and plating agent compositions are utilized.

Aqueous Acid A

50% fluoboric acid 20% water 80%

Aqueous Acid B

50% methane sulfonic acid 15% water 85%

Aqueous Acid C

50% methane sulfonic acid 30% water 70%

Aqueous Acid D ethane sulfonic acid 10% water 90%

Aqueous Acid E 2-hydroxypropane sulfonic acid 30% water 70%

Plating Agent F

RHODAPON LOS (sulfate ester of 10% n-octanol)

water 90%

Plating Agent G

Niaproof 08 (sulfate ester of 8% 2-ethyl hexanol)

50% methane sulfonic acid 20% water 72%

Plating Agent H

Ethofat O-20 (ethylene oxide 5% condensate of a fatty acid)

water 95%

Plating Agent I

TAMOL NNO (formaldehyde condensate 6% of a naphthalene sulfonic acid)

water 94%

Plating Agent J

Trycol OAL-23 (an ethoxylated 15% oleyl alcohol)

50% fluoboric acid 6% water 79%

The agitated container used to process the small arms projectiles in the following examples consists of an eight-sided steel plating tumbler that is open at one end and sits at approximately a 45° angle. It is connected by a shaft on the closed end to a motor that turns the shaft and therefore the barrel. The inside surface of the barrel is lined with a vinyl coating. The working volume of the barrel is about 1200 cubic centimeters.

In all of the examples below, the small arms projectiles were first precleaned in an alkaline cleaner. The cleaner used was a solution of 60 grams/liter of Tru-Plate 6100 Alk Clean in water. Tru-Plate 6100 Alk Clean is available from McGean-Rohco, Inc. of Cleveland, Ohio.

The projectiles were immersed in the cleaner which had been heated to a temperature of 160 degrees Farenheit and the mixture agitated for a period of 5 minutes. The cleaner solution was then decanted and the projectiles rinsed twice with water.

The copper and tin powders used in the examples have a particle size capable of passing through a 100 mesh screen and are nonspherical in shape.

EXAMPLE 1

1.5 mm lead alloy shot having a total surface are of 5 ft.$^2$ was precleaned and rinsed in the plating barrel as set forth above. 50 mls. of Aqueous Acid A and enough water to form a slurry with the shot were added to the plating barrel and the mixture agitated for a period of 5 minutes. 10 mls. of Plating Agent G was then added and agitation continued for 2 minutes. Copper powder (4 portions of 20 grams each) was added at 5 minute intervals and agitation continued for 20 minutes after the last portion of copper powder had been added. The liquid was decanted and the plated shot rinsed with water for 1 minute. Finally, the water was decanted and agitation of the plated shot was continued for 1 minute to polish.

EXAMPLE 2

0.22 caliber bismuth-tin alloy bullets having a total surface area of 5 ft.$^2$ were precleaned as previously set forth. 60 mls. of Aqueous Acid B and enough water to form a slurry with the bullets were added to the plating barrel and the mixture agitated for a period of 5 minutes. The acid solution was then decanted and the bullets rinsed with water for 1 minute. The water was decanted, and 20 mls. of Plating Agent F was added along with enough alkaline aqueous solution to form a slurry and to maintain the pH above 10. The alkaline aqueous solution had a composition comprising 30 grams of sodium hydroxide per liter of aqueous solution. After agitating the slurry for 5 minutes, copper powder (4 portions of 20 grams each) was added at 5 minute intervals and agitation continued for 20 minutes after the last portion of copper powder was added. The alkaline liquid was decanted and the jacketed bullets were rinsed twice with water, then allowed to dry.

EXAMPLE 3

Lead wire pieces having a total surface area of 5 ft.$^2$ were precleaned as previously set forth. 100 mls. of Aqueous Acid E and enough water to form a slurry with the wire pieces were added to the plating barrel and the slurry agitated for 5 minutes. 20 mls. of Plating Agent H was then added and agitation continued for 2 minutes. Copper powder (4 portions of 20 grams each) was added at 5 minute intervals and agitation continued for 30 minutes after the last portion of copper powder had been added. The acidic liquid was decanted, the copper coated wire rinsed with water for 1 minute and the rinse water decanted.

EXAMPLE 4

9 millimeter lead-alloy bullets having a total surface area of 5 ft.$^2$ were precleaned as previously set forth. 50 mls. of Aqueous Acid C and enough water to form a slurry with the bullets were added to the plating barrel and the slurry agitated for a period of 5 minutes. 10 mls. of Plating Agent J was then added and agitation continued for 2 minutes. 2o grams of tin powder was added and agitation continued for ten minutes. 20 grams of copper powder was then added and agitation continued for another 20 minutes. An additional 20 grams of tin powder followed by 20 grams of copper powder were added at the same intervals as the first additions and agitation continued for 30 minutes after the final copper powder portion had been added. The liquid was decanted, the jacketed bullets rinsed with water for 1 minute and the rinse water decanted. Agitation was then continued for 1 minute to polish.

EXAMPLE 5

4 mm bismuth-tin alloy shot having a total surface area of 5 ft.$^2$ was precleaned as previously set forth. 50 mls. of Aqueous Acid D and enough water to form a slurry with the shot were added to the plating barrel and the mixture agitated for a period of 5 minutes. The acid solution was then decanted and the shot rinsed with water for 1 minute. The water was decanted and 10 mls. of Plating Agent I added along with enough alkaline aqueous solution to form a slurry and to maintain the pH above 10. The alkaline aqueous solution had a composition comprising 30 grams of sodium hydroxide per liter of solution. After agitating the slurry for 5 minutes, copper powder (4 portions of 20 grams each) was added at 5 minute intervals and agitation continued for 20 minutes after the last portion of copper powder was added. The alkaline solution was decanted and the plated shot rinsed with water for 1 minute. The water was decanted and agitation continued for 1 minute to polish.

While the invention has been explained to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. A process for mechanically plating small arms projectiles with a coating of a metal, comprising the steps of:

(A) forming a slurry in an agitated container, said slurry comprising said small arms projectiles and an aqueous solution which contains components comprising a strong acid selected from the group consisting of fluoboric acid, alkane sulfonic acid and alkanol sulfonic acid;

(B) continuing to agitate said slurry until the surface of said small arms projectiles is essentially clean and free of oxide;

(C) adding to the agitated container a plating agent and a particulate plating metal and;

(D) continuing to agitate the container until said particulate plating metal has been mechanically applied over the surface of said small arms projectiles.

2. A process according to claim 1 wherein said small arms projectiles have a composition comprising a deformable metal selected from the group consisting of lead, an alloy of lead and an alloy of bismuth.

3. A process according to claim 2 wherein said particulate plating metal is copper.

4. A process according to claim 3 wherein said strong acid is fluoboric acid.

5. A process according to claim 3 wherein said alkane sulfonic acid and alkanol sulfonic acid are characterized by the following formulae $$RSO_3H \quad (I)$$

$$C_nH_{2n+1}—CH(OH)—(CH_2)_m—SO_3H \quad (II)$$

respectively where R is an aliphatic group containing from 1 to about 12 carbon atoms, n is from 0 to about 10, m is from 1 to about 11, and the sum of m+n is up to about 12.

6. A process according to claim 5 wherein said alkane sulfonic acid is methane sulfonic acid.

7. A process for mechanically plating small arms projectiles having a composition comprising a deformable metal selected from the group consisting of lead, an alloy of lead and an alloy of bismuth, with a coating of copper, said process comprising the steps of:

(A) forming a slurry in an agitated container, said slurry comprising said small arms projectiles and an aqueous solution which contains components comprising a strong acid selected from the group consisting of fluoboric acid and methane sulfonic acid;

(B) continuing to agitate said slurry until the surface of said small arms projectiles is essentially clean and free of oxide;

(C) adding to the agitated container a plating agent and particulate copper metal; and (D) continuing to agitate the container until said particulate copper metal has been mechanically applied over the surface of said small arms projectiles.

8. A process according to claim 7 wherein said strong acid is fluoboric acid.

9. A process according to claim 8 wherein said small arms projectiles have a composition comprising an alloy of lead.

10. A process according to claim 8 wherein said small arms projectiles have a composition comprising an alloy of bismuth.

11. A process according to claim 8 further comprising:

applying a thin coating of tin prior to any adding of said particulate copper.

12. A small arms projectile mechanically plated according to claim 1.

13. A small arms projectile mechanically plated according to claim 7.

14. A small arms projectile mechanically plated according to claim 9.

15. A small arms projectile mechanically plated according to claim 10.

* * * * *